US005321901A

United States Patent [19]

Kelly

[11] Patent Number: 5,321,901

[45] Date of Patent: Jun. 21, 1994

[54] STUDS AND SOCKETS FOR STUDDED FOOTWEAR

[75] Inventor: Paul A. Kelly, Atherstone, England

[73] Assignee: Trisport Limited, Straffordshire, United Kingdom

[21] Appl. No.: 930,547

[22] PCT Filed: Mar. 27, 1991

[86] PCT No.: PCT/GB91/00475

§ 371 Date: Sep. 28, 1992

§ 102(e) Date: Sep. 28, 1992

[87] PCT Pub. No.: WO91/15131

PCT Pub. Date: Oct. 17, 1991

[30] Foreign Application Priority Data

Apr. 3, 1990 [GB] United Kingdom ..... 9007519

[51] Int. Cl.[5] ..... A43B 5/00

[52] U.S. Cl. ..... 36/134; 36/65

[58] Field of Search ..... 36/134, 127, 65, 67 D, 36/132, 59 R, 59 A, 61, 62, 67 R

[56] References Cited

U.S. PATENT DOCUMENTS

| | | | |
|---|---|---|---|
| 2,299,927 | 10/1942 | Pierce et al. . | |
| 3,911,600 | 10/1975 | Dassler | 36/67 D |
| 4,492,047 | 1/1985 | Arff | 36/67 D |
| 4,587,748 | 5/1986 | Collins | 36/127 |
| 5,036,606 | 8/1991 | Erich et al. | 36/134 |
| 5,065,534 | 11/1991 | Collins | 36/134 |
| 5,123,184 | 6/1992 | Ferreira | 36/67 D |

FOREIGN PATENT DOCUMENTS

| | | |
|---|---|---|
| 318813 | 9/1929 | United Kingdom . |
| 282257 | 9/1988 | United Kingdom . |

*Primary Examiner*—Paul T. Sewell
*Assistant Examiner*—Thomas P. Hilliard
*Attorney, Agent, or Firm*—Schweitzer Cornman & Gross

[57] ABSTRACT

In a stud and socket combination for studded footwear, a moulded plastics socket (1) provides a threaded axial hole (5) bounded by an inner ring (9). A co-axial outer ring (10) is radially separated from the inner ring to leave an annular space (11). A plastics stud moulding (19) comprises an externally threaded sleeve (21) which can be screwed into the socket hole and a co-axial ring (26) which is spaced radially outwards from the sleeve to slide over the inner socket ring (9) and enter the annular space (11) when the stud and socket are assembled. Four part-cylindrical webs (29) project axially from the ring (26) into the space (11) and provide four axially-extending locking ribs (28) at 90° intervals which project radially outwards from the ring. On the inner surface of the outer ring (10) of the socket are formed four corresponding formations providing recesses (15) to receive the ribs (28). Each recess is bordered on one side by a lead-in ramp (16) and on the other side by a stop block (17). When the stud is screwed into the socket the projections ride over the ramps in turn, offering increasing resistance to rotation successively, until finally the projections engage the stop blocks (17) to prevent further rotation.

7 Claims, 2 Drawing Sheets

STUDS AND SOCKETS FOR STUDDED FOOTWEAR

BACKGROUND AND SUMMARY OF THE INVENTION

This invention relates to footwear of the kind adapted to have ground-engaging studs releasably attached to it. Footwear of that kind is often worn by people pursuing sports or games. The studs are generally intended to improve the grip of the footwear on the ground, and they may be of a wide variety of shapes. They may, for example be relatively blunt, with flat or rounded ends or more sharp, like spikes. For convenience of description, however, they will hereinafter be referred to generically as studs.

Detachable and replaceable studs are usually provided with spigots which are formed with external screw-threads. Each spigot can be screwed into a socket, in the underside of an article of footwear, formed with an internal screw-thread of complementary form.

Studs and sockets of those kinds are described and illustrated in the specifications of British patents Nos. 1 564 903, 2 028 102, 2 163 037, 2 115 683, 2 191 079 and British patent application No. 8805473 (publication No. 2 202 916A).

An object of the present invention is to provide an improved form of stud and socket.

From a first aspect the present invention consists in a combination of a stud and a socket for studded footwear in which the socket is formed with an internal screw-thread for receiving an externally screw-threaded spigot on the stud and in which the stud and socket have radially facing locking formations operative to come into mutual engagement when the spigot has been screwed into the socket to a predetermined axial position so as to impede the spigot from being screwed any further into the socket and to afford resistance to unscrewing, the stud and socket being fully assembled when the spigot is in said predetermined axial position, the arrangement being such that the stud can be unscrewed from the fully assembled position when a predetermined torque is applied to the spigot, at least one of the locking formations yielding resiliently to permit that unscrewing to occur.

The screw-threads on the stud and socket may comprise buttress threads. The screw-threads may be single-start threads but are preferably multi-start threads, a two-start thread being particularly preferred. The arrangement is preferably such, when a multi-start thread is employed, that the stud can be screwed into a fully assembled position whichever one of the thread starts on the stud comes into engagement with any selected one of the thread starts in the socket. The screw-threads on the stud and socket, whether single-start or multi-start, are preferably such that from an initial position, in which the threads are about to overlap each other, to the fully installed position (or to a fully installed position) the stud is rotated relatively to the socket through a total angle which is no more than one and a half full turns (540°) and no less than three quarters of a full turn (270°); the total angle is preferably no more than one and a quarter full turns (450°) and is most preferably about a full turn (360°).

Relative to the screw axis, the locking formations preferably comprise an outer locking formation on the socket and a complementary inner locking formation on the stud. In a preferred construction, the inner locking formation faces radially outwards from a ring constituting part of the stud and spaced radially outwards from the spigot, and the outer locking formation faces radially inwards from an outer ring constituting part of the socket and spaced radially outwards from an inner ring of the socket bounding its internal screw thread; in assembling the stud and socket the stud ring becomes inserted into an annular space between the inner and outer rings of the socket. The outer locking formation may be so constituted as to be situated at a single location or may be so constituted as to be situated at two or more spaced locations. Similarly the inner locking formation may be so constituted as to be situated at a single location or may be so constituted as to be situated at two or more spaced locations.

Preferably one of said inner and outer locking formations comprises at least one projection while the other of said locking formations provides at least one recess (for receiving the projection, or an associated one of the projections) and stop means operative to engage the projection immediately beyond the recess so as to prevent the spigot being screwed any further into the socket. Preferably it is the inner locking formation, on the stud, which consists of or includes the projection or projections.

From a second aspect the present invention consists in a stud for use in a combination in accordance with the first aspect of the present invention.

From a third aspect the present invention consists in a socket for use in a combination in accordance with the first aspect of the present invention.

From a fourth aspect the present invention consists in an article of footwear incorporating at least one socket in accordance with the third aspect of the present invention.

An embodiment of the present invention is illustrated, by way of example, in the accompanying drawings.

DESCRIPTION OF PREFERRED EMBODIMENTS

Figure 1:
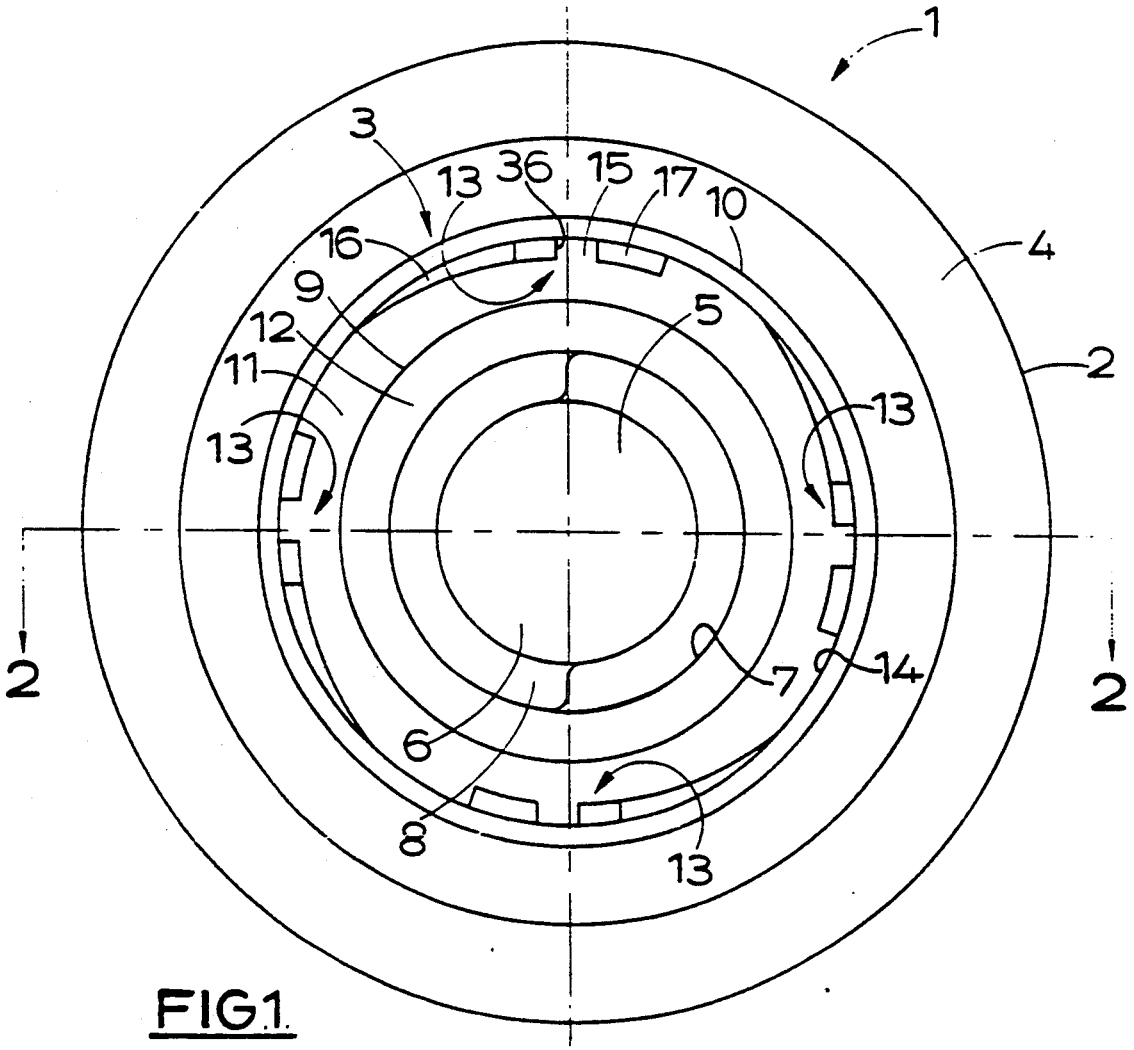
FIG. 1 is a plan view of a socket.
Figure 2:
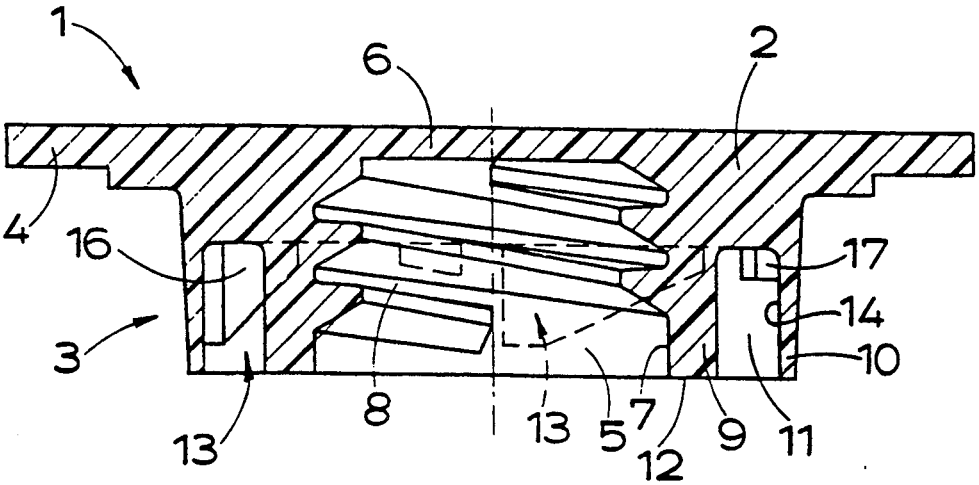
FIG. 2 is a section along the line 2—2 of FIG. 1.

The socket 1 shown in FIGS. 1 and 2 in its normal orientation in use is intended for incorporation in an article of footwear such as a golf-shoe. The socket is made as a unitary moulding of a plastics material such as an acetal resin and comprises a circular top plate 2 with a central boss 3 depending from it; a portion of the plate 2 projecting radially outwards beyond the boss 3 forms an annular anchoring flange 4 of the socket. The boss has an axial hole 5 which is open at the bottom and closed at the top by a closure disc 6 provided by the plate 2. A short entry part 7 of the hole is cylindrical while the remainder of the hole is formed with an internal screw-thread 8 which is a two-start buttress thread. The reasons for using a buttress thread and a suitable profile of buttress thread are described in more detail in the specification of the aforementioned British patent No. 2 115 683.

The boss 3 comprises a stout cylindrical wall forming an inner ring 9, which bounds the entry part 7 of the hole 5 and also an axially outer portion of the screw thread 8, and a relatively thin and slightly flexible wall forming an outer ring 10. The rings 9 and 10 are co-axial and radially separated to leave an annular space 11 there between. The inner ring 9, bordering the hole 5, has a planar annular end face 12 in a plane normal to the axis of the hole.

A locking formation on the outer ring 10 comprises four similar locking units 13 which are situated within the annular space 11 at 90° intervals about the socket axis. The locking units 13 are formed on a generally cylindrical inner face 14 of the ring 10, so as to face radially inwards. Each locking unit forms a recess 15 bordered on one side (i.e. considered circumferentially, as viewed in FIG. 1) by a lead-in ramp 16 and on the other side by a stop block 17 which is of a uniform radial thickness equal to the maximum radial dimension of the lead-in ramp. As can be seen in FIG. 2, the lead-in ramp 16 is based at the closed (upper) end of the annular space 11 and is of increasing width (measured axially) between its start and a terminal portion bordering the recess 15, for a purpose hereinafter referred to; its width varies from a little under one quarter of the screw pitch at its start to around three quarters of the pitch at its terminal portion. The stop block 17 has an axial width of one quarter of the pitch, also being based at the closed end of the annular space 11.

Figure 3:
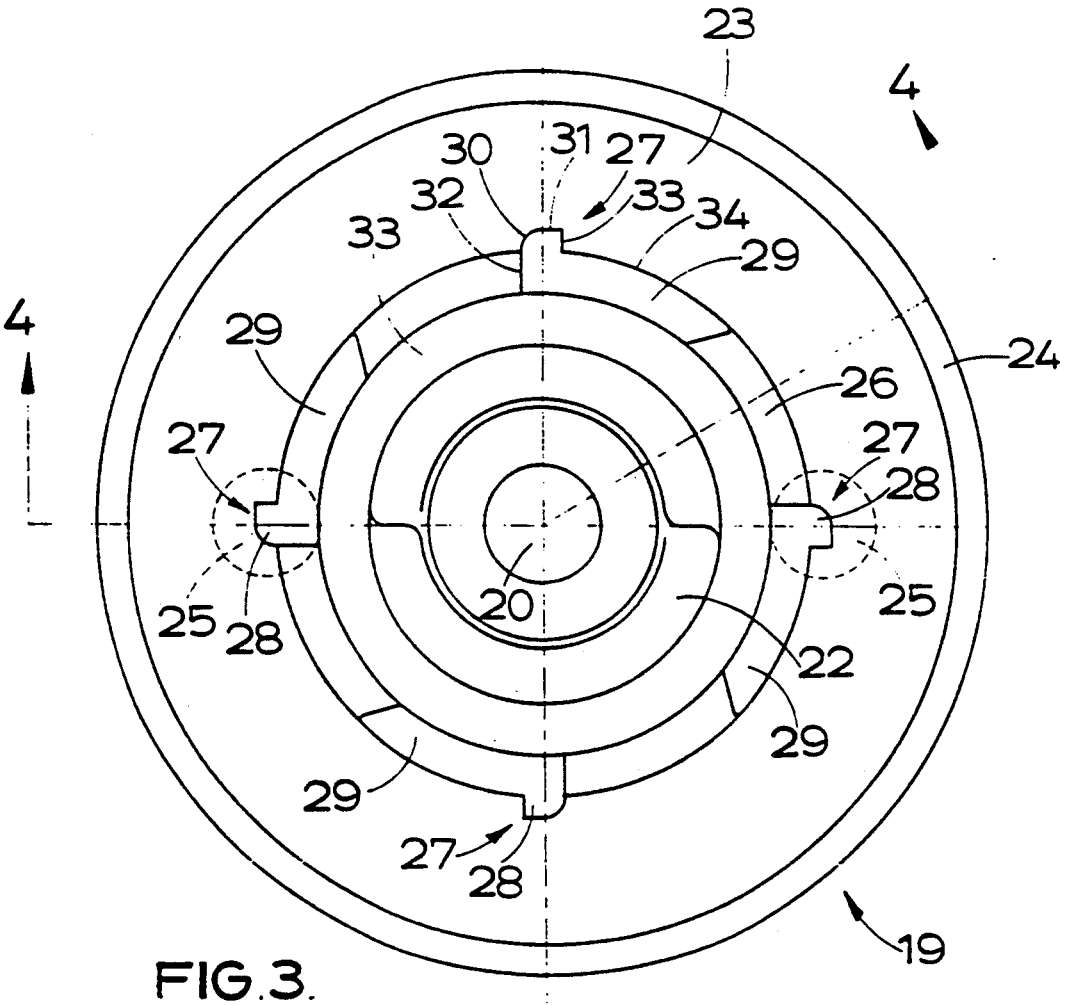
FIG. 3 is a view from below of a moulding constituting part of a stud for use with a socket of the kind illustrated in FIGS. 1 and 2.
Figure 4:
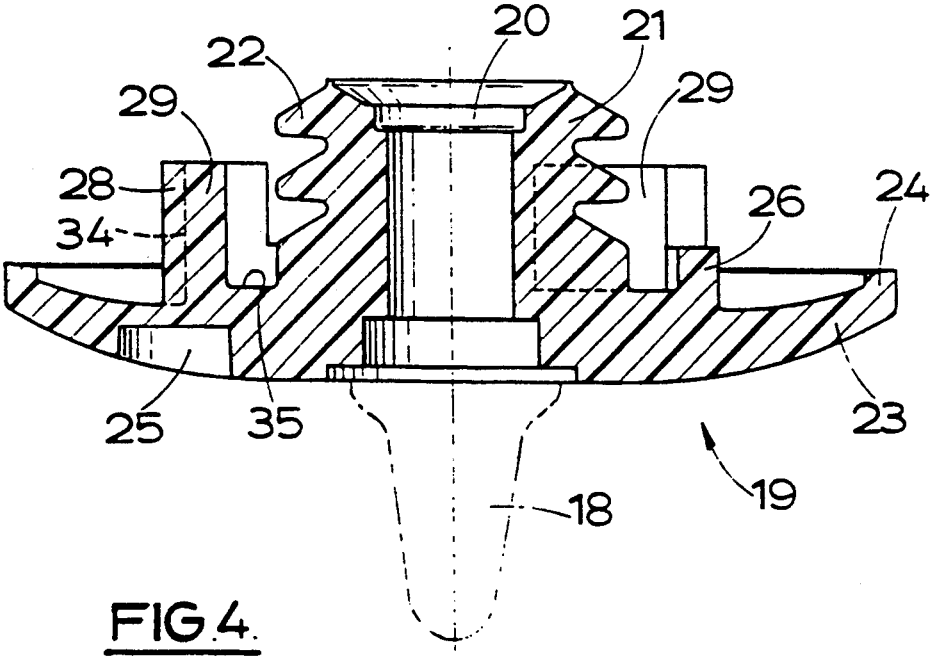
FIG. 4 is a section along the line 4—4 of FIG. 3.

The socket 1 is designed for use with a complementary stud. The stud comprises a central metal pin element 18 (indicated in broken lines in FIG. 4) and a unitary moulding 19 of a plastics material which is illustrated in FIGS. 3 and 4. The metal pin element is of the kind that is described and illustrated in the specification of the aforementioned British Patent No. 2 028 102 and is assembled with the moulding 19 in the same manner as that described in that specification: a stem of the pin element being passed through an axial hole 20 in the moulding and an end portion of the stem then being deformed to secure the pin element and the moulding permanently together, a ground-engaging head extending axially from the other end of the stem, and an outwardly directed flange engaging that side of the moulding adjacent to the ground-engaging head. The axial hole 20 has at its lower end a flared enlargement to accommodate, at least in part, the deformed end portion of the stem, and has at its upper end an enlargement to accommodate, at least in part, the flange.

The moulding 19 comprises a tubular sleeve 21 formed with an external two-start screw-thread 22 of a shape complementary to the shape of the screw-thread 8 in the socket 1. A flange 23 of circular outline and co-axial with the sleeve 21 extends outwards from the lower end of the sleeve and is in the shape of a shallow dish with a raised peripheral rim 24. A pair of diametrically opposed recesses 25 is formed in the outer (bottom) surface of the flange and in use they receive pins of complementary shape on a face spanner used for screwing the stud into engagement with the socket 1 and for unscrewing it from that engagement. When the moulding has been assembled with a pin element to form a stud, the stud includes an externally screw-threaded spigot which is constituted by the sleeve 21 and the stem of the pin element inside it.

A ring 26 projects upwards co-axially from the flange 23 at a location spaced radially outwards from the sleeve 21. The inner diameter of the ring is complementary to the outer diameter of the inner ring 9 of the socket 1, for the former to slide over the latter in assembly of the stud with the socket. A locking formation is provided as part of the moulding 19 and faces radially outwards. The locking formation comprises four similar locking units 27 which are situated at 90° intervals about the stud axis. Each of those locking units comprises a radially outwardly directed projection 28 mounted on the ring 26 and shaped to engage in an associated one of the recesses 15 of the locking units 13 of the socket 1. Each radial projection 28 is in the form of an axially extending rib provided on the side of a leading end portion (in the screwing-up direction) of a part-cylindrical web 29 which is formed as an axial extension from the ring 26. A leading side face 30 of the rib is rounded off to give a smooth convex corner profile joining a flat outer face 31 of the rib and a flat leading end face 32 of the web 29. A trailing side face 33 of the rib is flat and generally square with the outer face 31 and with a cylindrical outer surface 34 of the web 29 where it joins it. Between the ring 26 and the sleeve 21 there is a planar annular bearing surface 35 formed by an inner surface of the flange 23.

In use the socket 1 is incorporated in the sole or heel of an article of footwear such as a golf shoe but for convenience of description it will be assumed that the socket is incorporated in the sole. The boss 3 is housed in a hole in the sole. The end face 12 of the inner ring 9 of the boss (and a coplanar end face of the outer ring 10) is flush with the adjacent part of the ground-engaging surface of the sole or very slightly recessed into the hole.

The stud is installed by the insertion of the spigot into the hole 5 in the socket and its rotation to cause the screw-thread 22 on the sleeve 21 to engage in the socket-thread 8. The threads are so shaped that they become fully engaged on rotation of the sleeve through 360°, starting from an initial position in which the threads are about to overlap each other. Immediately before the ends of the screw-threads overlap each other, with the sleeve in its initial position, each of the projections 28 is aligned with the recess 15 in an associated locking unit 13 spaced axially from it. As the stud is rotated relatively to the socket the sleeve 21 is drawn into the hole 5 in the socket and the ring 26 (with locking units 27) is drawn into the annular space 11 between the inner and outer rings 9 and 10 of the socket boss 3. At the end of each of the four successive partial rotations of 90°, as the stud is screwed in, the locking projections 28 of the stud engage and ride over adjacent lead-in ramps 16 of the locking formation of the socket. Owing to the circumferentially tapered form of the ramps, the first such engagement is slight and short. In the second and third engagements there are successively greater amounts of axial overlap between the projections and the ramps, and also longer contacts with the ramps as the ramps are engaged earlier in the rotation. The consequence is that each successive engagement is sensed by the user inserting the stud as an increased resistance to rotation, and increasingly loud "clicks" may be heard as each ramp is overrun in turn. Finally, the projections ride over substantially the whole lengths of the fourth ramps they meet, and then snap into the recesses 15 between the ramps 16 and the stop blocks 17. Further rotation of the stud is then prevented by the abutment of the projections 28 with the blocks 17 and installation is complete.

During insertion of the stud, the rounded leading side faces 30 of the projections facilitate this engagements with the ramps 16, particularly with the first and second such engagements where the meeting is abrupt.

It is to be noted that the resilient deformation required to permit the stud projections to ride over the socket ramps is achieved by providing for some flexibility in the outer ring 10 of the socket; the ring is actually distorted from its cylindrical form when the ramps are engaged, but returns to its original shape when the ramps are passed. This arrangement can be particularly convenient in allowing the stud moulding 19 to be of a more hard and stiff material than the socket.

When the stud is fully installed, the annular bearing surface 35 of the moulding is designed to abut the end face 12 of the socket moulding, and the stud sleeve 21 to abut the closure disc 6 at the end of the socket hole 5.

When the stud is fully assembled with the socket, the ring 26 embraces an end portion of the inner socket ring 9, and the peripheral rim 24 on the flange 23 presses into the surface of the sole.

Abutment of the trailing side faces 33 of the stud projections 28 against opposed end surfaces 36 of the socket ramps 16 resists any attempt to unscrew the stud from the socket. However, with sufficient torque applied the stud can be unscrewed. The relative inclinations and forms of such opposed surfaces can be varied to determine the torque necessary, as also can the shapes of the projections and recesses.

Numerous modifications may be made without departing from the scope of the invention. For example, the recesses 15 and the complementary projections 28 may be different shapes in plan.

In the design illustrated, the stud is rotated through only 360° to achieve full installation. If desired the screw-threads 8 and 22 could be made longer so that additional rotation is required. That, however, would lead to an increased axial length of the socket and the stud moulding; while the latter might be acceptable, the former would normally be a disadvantage as it would require the sole to be of correspondingly increased thickness. Moreover, while the threads could be made shorter, so requiring a total rotation of less than 360°, that is normally inadvisable as the loading on the threads in use may become unacceptably high.

While two-start threads are preferred, it would be possible to have single-start threads or threads with three or even more starts. Likewise, the number of units of each of the locking formations may be varied. There may, for example, be three or more recesses (such as the recesses 15) and three or more projections (such as the projections 28). Whatever number is employed the recesses or the projections, as the case may be, are preferably disposed symmetrically around the axis of the component of which it forms a part. With the design illustrated, the thread 22 of the stud can be engaged with the thread 8 of the socket beginning in either of two positions which are 180° apart. Nevertheless the engagement between the projections and their recesses occurs in a similar manner whether the threads begin to engage in one position or the other. Whatever modifications are made to the number of starts and/or the number of recesses and complementary projections it is preferred to arrange for the projections to engage recesses in a similar manner irrespective of the relative starting positions of the threads.

In the embodiment described above with reference to the drawings, there are two recesses 25 for assisting in the installation of the stud and its removal. The number and shape of the recesses may be varied as desired. For example there may be three recesses; conveniently they are disposed symmetrically about the axis of the stud.

The socket will normally be one of a number of similar sockets incorporated in an article of footwear and there will normally be the same number of similar studs which are or can be interchangeably attached to the sockets. The sockets may be in the sole and/or the heel of the article of footwear The sole and/or heel may be formed as a moulding around the preformed sockets or may be moulded integrally with the sockets. Alternatively the soles and/or heels may be constructed around the sockets from pre-formed materials such as sheet leather.

It is highly desirable that the sockets should be incorporated in the article of footwear in such a manner that they are anchored firmly against rotation. To this end the sockets may be adhesively secured in place or the anchoring flanges 4 may be pierced to allow moulded material constituting part of the sole and/or heel to flow through them. In a further alternative two or more sockets are secured to or are formed integrally with a common support, a suitable arrangement of this kind being described and illustrated in the specification of the aforementioned British patent No. 2 115 683.

I claim:

1. A combination of a stud and a socket for studded footwear in which the socket is formed with an internal screw-thread for receiving an externally screw-threaded spigot on the stud and in which the stud and socket have radially facing locking formations operative to come into mutual spigot-stopping engagement only upon the spigot being screwed into the socket to a predetermined axial position in which the stud and socket are fully assembled, the interengaged locking formations preventing the spigot from being screwed any further into the socket and affording resistance to unscrewing, at least one of the locking formations yielding resiliently to permit that unscrewing to occur, one of said locking formations comprising at least one radial projection and the other locking formation comprising at least one recess and stop means arranged to be engaged by the projection immediately beyond the recess so as to impede the stud from being screwed any further into the socket, said other of said locking formations comprising a radially-facing lead-in ramp over which the projection rides before snapping into the recess adjacent to the stop means.

2. A combination according to claim 1 in which the locking formations provide a plurality of projections and a corresponding plurality of recesses distributed uniformly about the screw axis.

3. A combination according to claim 2 in which the locking formations provide that in successive interengagements between them, as the stud is screwed into the socket in assembly of the combination, the locking formations increasingly overlap to give rise to successively increased resistance to rotation from such engagements, said stop means being so positioned that when the stud reaches its fully assembled position said stop means becomes engaged by one of the projections.

4. A combination according to claim 1 in which the screw thread on the stud spigot and in the socket is a multi-start buttress thread.

5. A combination according to claim 1 in which the stud and socket include stop means cooperating to cause the stud to be moved to the fully assembled position, from an initial position in which the stud and socket threads are about to overlap, by a rotation which is not less than 270° and not more than 450°.

6. A combination according to claim 1 in which the locking formations comprise radially outer locking formation on the socket and complementary radially inner locking formation on the stud.

7. A combination according to claim 6 in which the inner locking formation faces radially outwards from a stud ring constituting part of the stud and spaced radially outwards from the spigot, and the outer locking formation faces radially inwards from an outer ring constituting part of the socket and spaced radially outwards from an inner ring of the socket bounding its internal screw thread, the stud ring being received into an annular space between the inner and outer rings of the socket.

* * * * *